US008312857B2

(12) United States Patent
Jessberger et al.

(10) Patent No.: US 8,312,857 B2
(45) Date of Patent: Nov. 20, 2012

(54) OIL PAN FOR AN INTERNAL COMBUSTION ENGINE

(75) Inventors: Thomas Jessberger, Asperg (DE); Roman Eder, Ludwigsburg (DE)

(73) Assignee: Mann + Hummel GmbH, Ludwigsburg (DE)

( * ) Notice: Subject to any disclaimer, the term of this patent is extended or adjusted under 35 U.S.C. 154(b) by 148 days.

(21) Appl. No.: 12/675,690

(22) PCT Filed: Aug. 27, 2008

(86) PCT No.: PCT/EP2008/061247

§ 371 (c)(1), (2), (4) Date: Jul. 21, 2010

(87) PCT Pub. No.: WO2009/027441

PCT Pub. Date: Mar. 5, 2009

(65) Prior Publication Data

US 2010/0282203 A1 Nov. 11, 2010

(30) Foreign Application Priority Data

Aug. 27, 2007 (DE) ..... 10 2007 040 666

(51) Int. Cl.
*F01M 5/00* (2006.01)
*F01M 1/02* (2006.01)

(52) U.S. Cl. ..... 123/195 C; 123/41.33; 123/196 AB; 123/196 R

(58) Field of Classification Search ..... 123/41.33, 123/195 C, 196 A, 196 AB; 184/6.21, 6.22, 184/6.24, 104.1–104.3
See application file for complete search history.

(56) References Cited

U.S. PATENT DOCUMENTS 5,934,241 A * 8/1999 Von Esebeck et al. .... 123/196 R
6,058,898 A * 5/2000 Freese ..... 123/195 C
6,705,270 B1 * 3/2004 Rau et al. ..... 123/195 C

FOREIGN PATENT DOCUMENTS

EP 0807748 11/1997

OTHER PUBLICATIONS

Internation search report of PCT/EP2008/061247.

* cited by examiner

*Primary Examiner* — Noah Kamen
(74) *Attorney, Agent, or Firm* — James Hasselbeck

(57) ABSTRACT

The invention relates to an oil pan made of thermoplastic for an internal combustion engine, said oil pan comprising integrated oil cooler and an integrated oil filter, a straight connection opening being provided between the oil cooler and the oil filter.

9 Claims, 5 Drawing Sheets

OIL PAN FOR AN INTERNAL COMBUSTION ENGINE

CROSS REFERENCE TO RELATED APPLICATIONS

This application is US National Stage Entry of international patent application no. PCT/EP2008/061247, filed Aug. 27, 2008 designating the United States of America. Priority is claimed based on Federal Republic of Germany patent application no. 10 2007 040 666.7, filed Aug. 27, 2007, the entire disclosure of which is incorporated herein by reference.

TECHNICAL FIELD

The invention concerns an oil pan for an internal combustion engine.

PRIOR ART

DE 197 39 668 discloses an oil pump module comprised of an oil pump, an oil cooler, and an oil filter in an assembly. It comprises a base member that is embodied as a plastic housing. From one side, an oil pump is inserted, an oil cooler and an oil filter from the other side. Moreover, the oil pump is sealed by means of the base member relative to the housing of the internal combustion engine that drives also the oil pump. The oil module itself is however not adapted to the oil pan but to the housing of the internal combustion engine.

Furthermore DE 41 40 667 discloses a lubricant oil device comprised of several devices such as an internal combustion engine, torque converter, shifting clutch, gearbox, retarder and drive unit of a motor vehicle. Each of the devices has an oil collecting chamber for storing a lubricant oil quantity with a vacuum line and a supply line. The oil collecting chambers are connected to a common lubricant oil circuit with an oil pump, an oil cooler and an oil filter wherein the oil collecting chambers each have a certain filling level and devices for ensuring a normal oil level are present. This arrangement as a whole is very complex with respect to manufacture and requires a high mounting expenditure.

EP 0 807 748 discloses an oil pan for an internal combustion engine with oil passages integrally formed in the housing of the oil pan wherein the oil pan together with an oil filter and an oil pump as a unit is mountable on the internal combustion engine. The oil pump is arranged within the oil pan. An oil filter housing with an oil filter is also arranged within the oil pan and is connected thereto. At least one part of the oil filter housing is formed by a wall section of the oil pan itself. The pressure passage that extends from the oil pump to the oil filter is embodied as a riser whose highest point is above the normal oil level of the oil pan. By integration of the oil filter into the oil pan the access to the oil filter for maintenance work is made significantly more difficult and a reliable sealing action of the oil pan requires a high mounting expenditure.

The invention has the object to avoid the aforementioned disadvantages and to provide an oil pan for an internal combustion engine that is of a simple and reliable design.

This object is solved by the features of the independent claim 1.

SUMMARY OF THE INVENTION

According to the invention the oil cooler and the oil filter are integrated components of the oil pan. The neighboring arrangement of oil cooler and oil filter provides a straight connecting opening between the two components so that a complex oil guiding passage between cooler and filter is not required.

According to a further embodiment, the oil filter is partially integrated into the oil pan. Important in this connection is the simple servicing of the oil filter. This is achieved in that the servicing-relevant parts are arranged outside of the oil pan.

In one embodiment of the invention, one or two oil passages are produced between cooler and filter by a retractable core. Advantageously, both cooler connectors for the oil cooler can be produced with a single retractable core.

A further embodiment of the invention provides that the supply as well as the outlet for the oil module, comprised of oil cooler and oil filter, in the oil pan are aligned parallel and in the main removal direction for removing the plastic part from the injection mold.

A method for producing an oil pan for an internal combustion engine provides that the injection mold is to be matched to the pan contour of the oil pan and to employ at least one retractable core that extends approximately at a right angle to the closing direction of the injection mold so that this retractable core forms one or two passages in the oil pan. These passages serve as a connection between oil cooler and oil filter.

These and further features may not only be taken from the claims but also from the drawings and the description.

BRIEF DESCRIPTION OF THE DRAWINGS

The invention will be explained in the following with the aid of embodiments in more detail. It is shown in.

DESCRIPTION OF THE PREFERRED EMBODIMENTS

Figure 1:
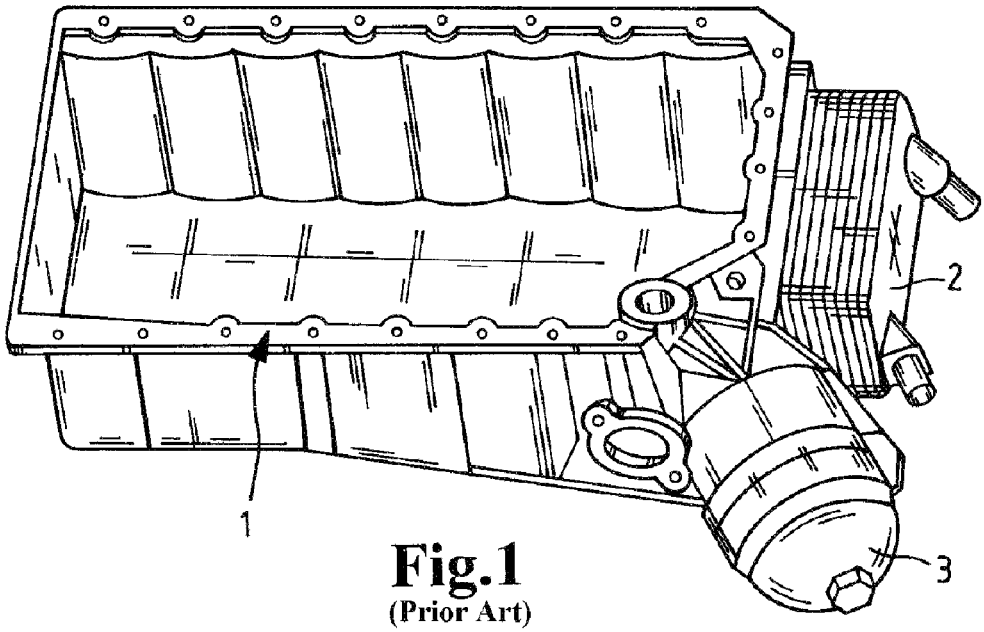
Fig.1 (Prior Art)
FIG. 1 an already known oil pan.
Figure 1A:
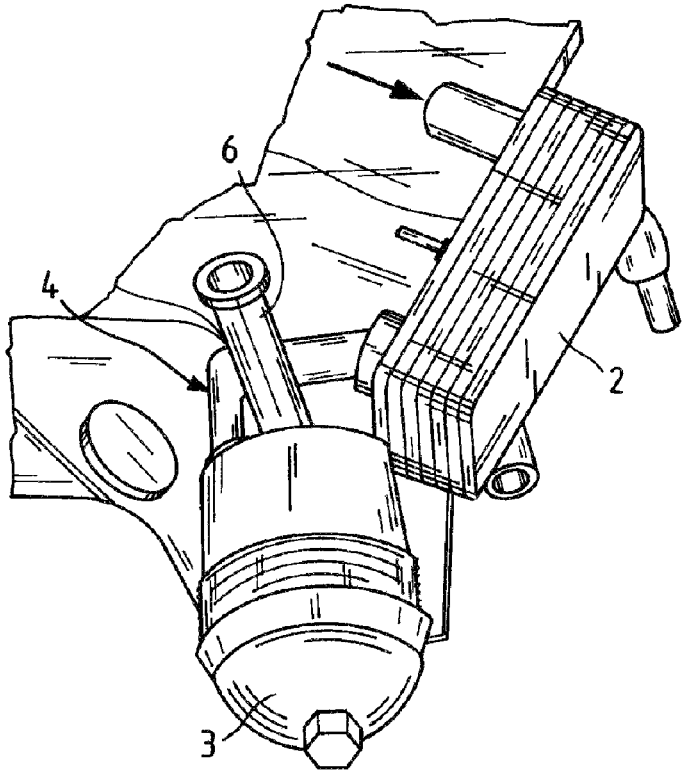
Fig.1a (Prior Art)
FIG. 1*a* a detail illustration of the oil pan shown in FIG. 1.

FIG. 1 shows an oil pan 1 that is comprised of thermoplastic synthetic material and on which are attached an oil cooler 2 and an oil filter 3. The oil pan is provided in the area of the oil filter 3 and the oil cooler 2 with appropriate conduits, i.e., a connection between the two elements is required. This connection is illustrated in FIG. 1*a*. The oil filter is connected by an oil supply passage 4 with the oil cooler 2. The oil supply passage is an additional component within the oil pan 1. The oil flows through the connector 5 into the oil cooler, is cooled therein in the conventional way by supplying cooling water, exits through connector 4 from the oil cooler and flows to the oil filter 3 and exits from the oil filter through conduit 6 by means of which the oil reaches the lubricating sites of the internal combustion engine.

Figure 2:
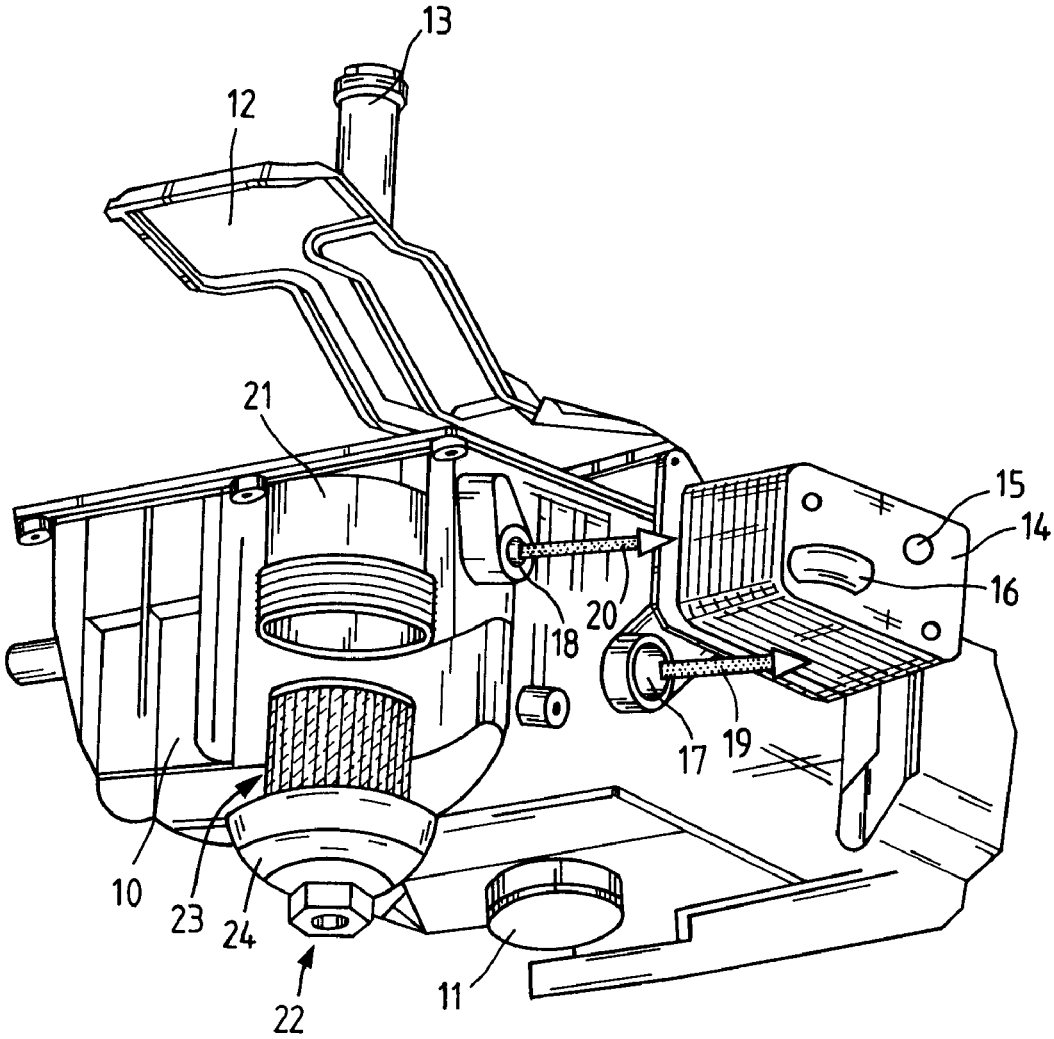
FIG. 2 a schematic illustration of an oil pan with an integrated oil module.

FIG. 2 shows in schematic illustration an oil pan with an oil module as an embodiment of the invention. The oil pan 10 is illustrated in a bottom view. On the side of the oil pan 10 there is a closure plug 11 for removing the used oil. Within the oil pan 10, a vacuum passage in the form of a flow-guiding wall 12 with a connector socket 13 to an oil pump, not illustrated, is provided. This flow-guiding wall 12 that is illustrated here for improved representation external to the oil pan is usually attached to the bottom within the oil pan by means of vibration welding methods. To the right side on the oil pan 10 an oil cooler 14 in the form of a plate oil cooler is illustrated. This oil cooler is comprised of a stack of cooler plates between which alternatingly oil and cooling water is present. The cooling water is supplied and removed by connectors 15 and 16. The supply or discharge of the oil to be cooled is realized by connectors 17, 18. The arrows 19, 20 show the removal direction for producing the connecting openings, i.e., when producing the oil pan in an injection mold retractable cores are arranged at these positions in the injection mold so that a simple manufacture of the passages is possible. While the connector 17 is required for supplying the oil to the oil cooler, by means of connector 18 the discharge of the cooled oil immediately into the oil filter housing 21 is realized. In the oil filter housing 21 the oil filter 22 is arranged. It is comprised of a zigzag folded filter insert 23 which may be matched to an oil filter lid 24 wherein the oil filter lid 24 can be screwed onto the oil filter housing 21.

Figure 3:
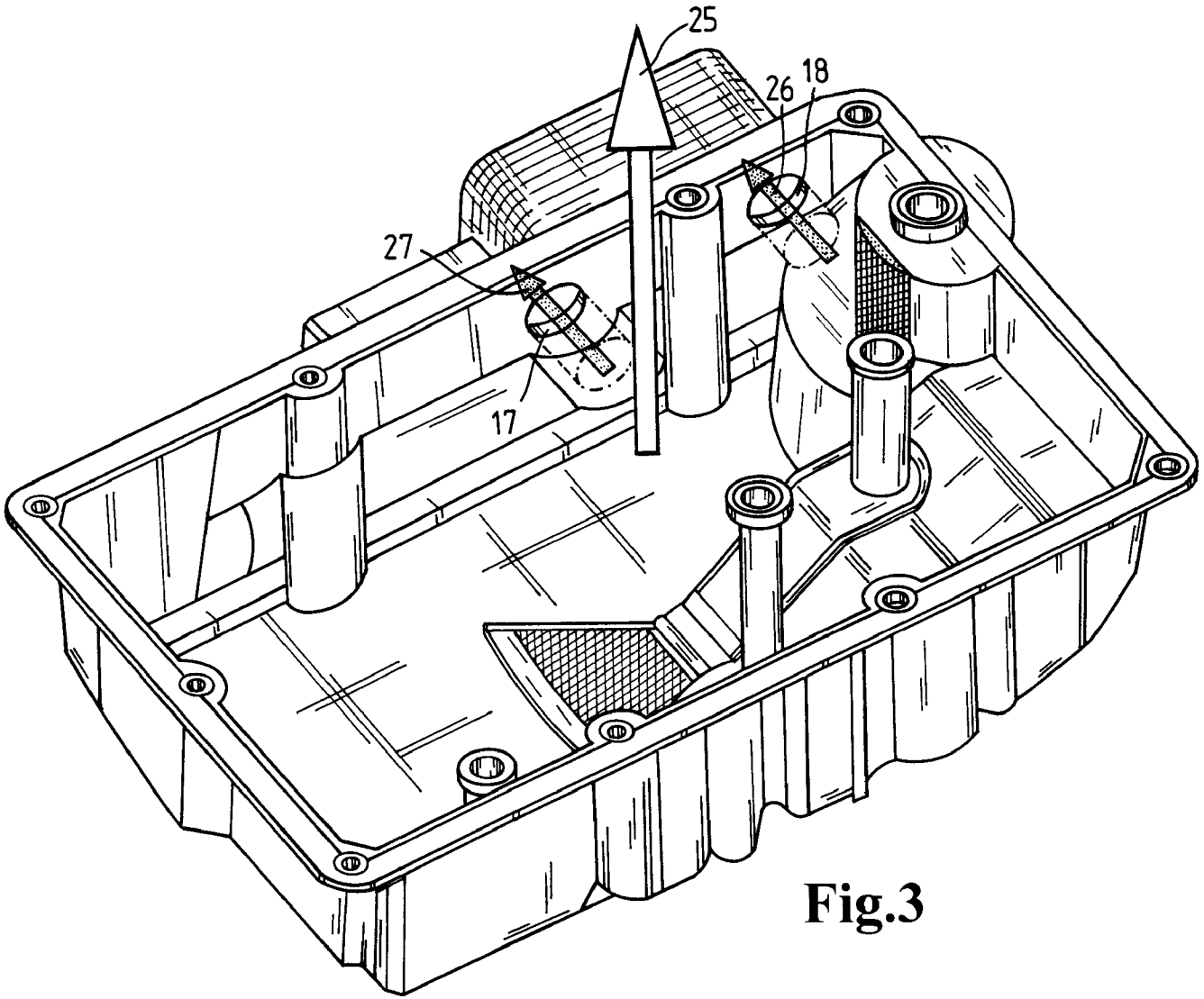
FIG. 3 the oil pan illustrated in FIG. 2 in an interior view and with the removal directions for the injection mold.

FIG. 3 shows an interior view of the system shown in FIG. 2. Same parts are identified with same reference numerals. It is shown how the oil pan is producible in an injection mold for synthetic material, of course without the additional parts such as the flow-guiding wall 12 or oil cooler 14 and oil filter 22. The removal direction of the mold for the oil pan as a whole is illustrated by the arrow 25. The removal direction for the two connectors 17, 18 is indicated by the two arrows 26, 27. Ultimately, in the injection mold retractable cores are positioned that are arranged substantially at a right angle to the removal direction of the oil pan and produce the openings in the oil pan. The opening for the connector 18 is a direct connection between the oil cooler and the oil filter. This means that a flow deflection for the cooled oil is not required here.

Moreover, the illustration as a whole also shows that also the further required openings can be produced in the main removal direction.

Figure 4:
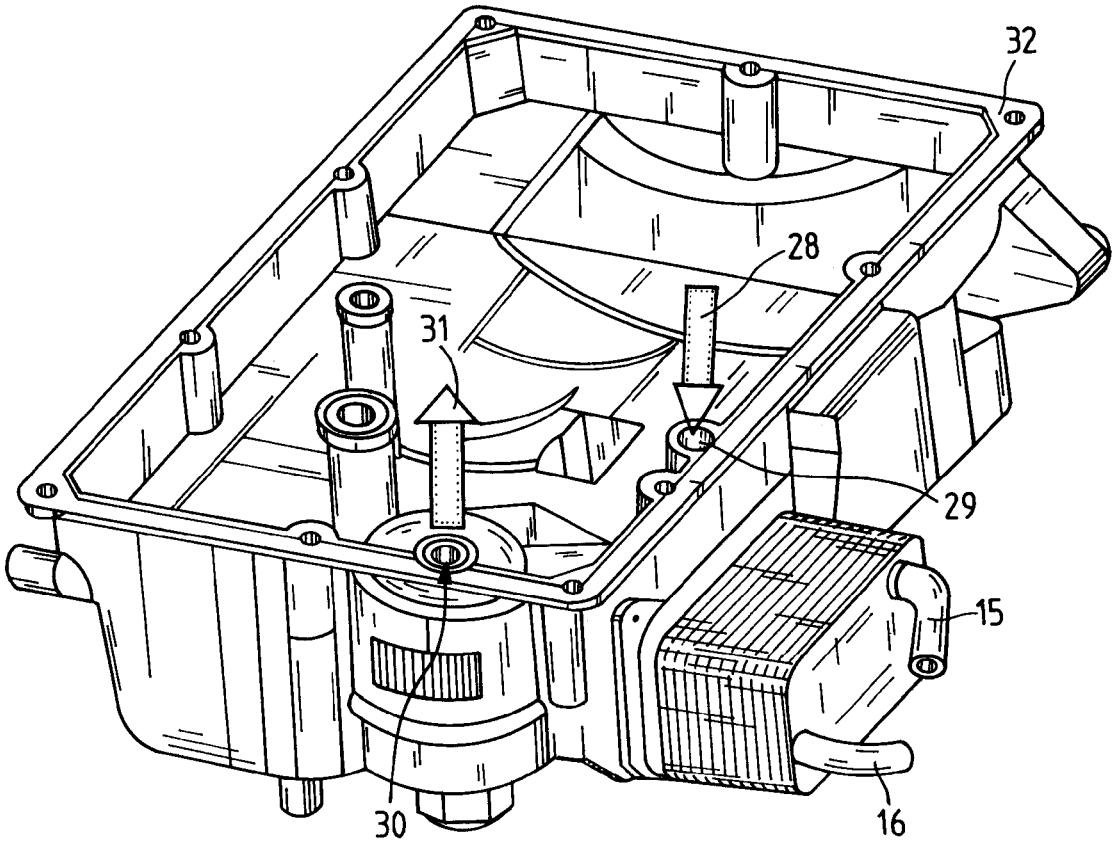
FIG. 4 a further view of the oil pan with illustration of the oil supply and oil discharge on the oil module.

FIG. 4 shows a further view of the oil pan with illustration of the oil supply to the oil module and the oil discharge from the oil module. Based on the oil pump, not illustrated here, according to the arrow 28 the oil is supplied through the opening 29 to the oil cooler in this illustrated variant. Discharge is done after cleaning in the oil filter through the opening 30 according to arrow 31 to the lubrication sites of the internal combustion engine. Sealing of the openings relative to the housing or to the openings at the internal combustion engine is realized by a single axial seal that extends along the sealing surface 32 in the oil pan. The sealing profiled section that is inserted into the sealing surface surrounds the aforementioned openings 29 and 30.

Figure 5:
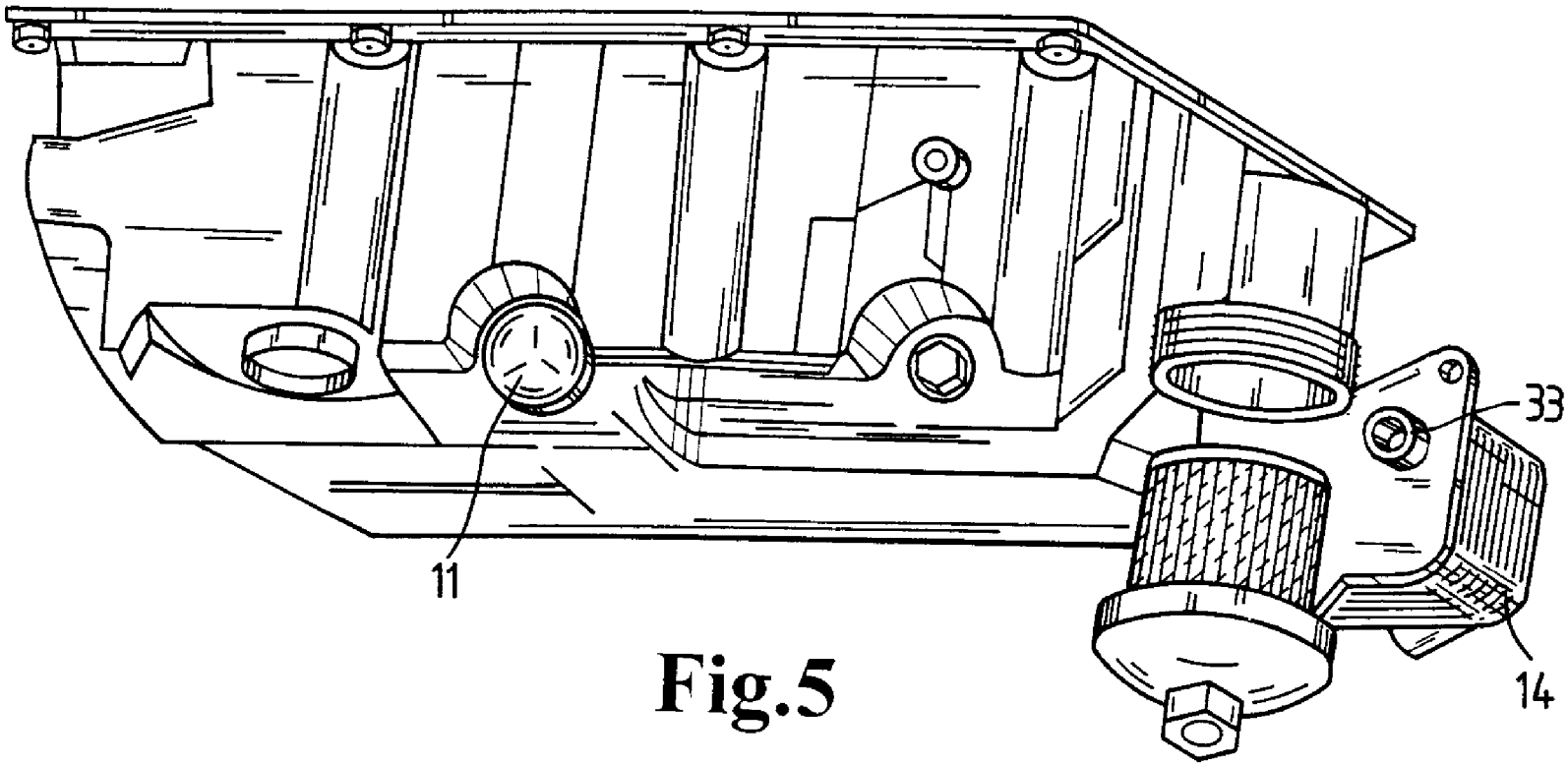
FIG. 5 the oil pan illustrated in FIG. 2 in a bottom view with a radially sealed oil cooler.

FIG. 5 shows the oil cooler 14 that is provided with connecting sockets for the supply and discharge of oil. The connecting socket 33 is visible in this illustration. It can be sealed in a simple way in the corresponding opening of the oil pan by means of a radial seal, for example, by an O-ring. Also sealing of the closure plug 11 is realized by an O-ring.

The invention claimed is:

1. An oil pan for an internal combustion engine, comprising:

an oil pan housing configured to secure to an internal combustion engine;

an oil filter arranged on and integrated with said oil pan housing, said oil filter including an oil filter housing; and a filter insert received into said filter housing and configured to filter contaminants from oil;

an oil cooler arranged on and integrated with said oil pan housing; and an oil passage extending between and interconnecting said oil cooler and said oil filter;

wherein said oil cooler is secured onto said oil pan housing;

wherein said oil pan housing is molded of a thermoplastic synthetic material;

wherein connectors sealably connect into said oil pan housing;

wherein an oil module comprises said oil cooler and said oil filter;

wherein an oil supply as well as an oil discharge for the oil module in the oil pan is aligned parallel and in a main removal direction of removing the oil pan housing from an injection mold tool.

2. The oil pan according to claim 1, wherein the oil filter is at least partially integrated into the oil pan housing and has oil inlet and outlet connections within said oil pan housing.

3. The oil pan according to claim 2, wherein the oil passage between the oil cooler and oil filter is produced by a retractable core.

4. The oil pan according to claim 3, wherein said oil cooler includes an oil inlet connector and an oil outlet connector;

wherein said oil pan housing includes an oil cooler oil inlet connector; and an oil cooler oil outlet connector;

wherein said oil cooler inlet and outlet connectors are produced in said oil pan housing with a single retractable core.

5. The oil pan according to claim 1, wherein said oil cooler includes an oil inlet connector; and an oil outlet connector;

wherein the oil connectors of the oil cooler have radial seals.

6. A method for producing the oil pan according to claim 1 including an oil pan contour of thermoplastic synthetic material for an internal combustion engine by an injection molding process, comprising:

providing at least one retractable core;

inserting said at least one retractable core into an injection mold tool, the at least one core aligned and configured to produce at least one oil passage in said oil pan contour, said at least one oil passage extending substantially at a right angle to a closing direction of the injection mold; and injecting thermoplastic synthetic material into said injection mold tool to produce said oil pan contour with said at least one oil passage therein.

7. The method according to claim 6, wherein in said inserting step, said at least one oil passage is two oil passages; and wherein said two oil passages are produced with one retractable core.

8. The method for producing an oil pan according to claim 7, wherein in said inserting step, said closing direction aligns with a main removal direction for removing said oil pan contour from said injection mold tool; and wherein said injecting step further includes forming an oil supply conduit and an oil discharge conduit in said oil pan contour in a direction parallel to the main removal direction.

9. The method for producing an oil pan according to claim 6, wherein in said inserting step, said closing direction aligns with a main removal direction for removing said oil pan contour from said injection mold tool; and wherein said injecting step further includes forming an oil supply conduit and an oil discharge conduit in said oil pan contour in a direction parallel to the main removal direction.

* * * * *